US012492883B2

(12) United States Patent
Kennedy et al.

(10) Patent No.: US 12,492,883 B2
(45) Date of Patent: Dec. 9, 2025

(54) HOLSTER

(71) Applicant: Safariland, LLC, Jacksonville, FL (US)

(72) Inventors: David Kennedy, Jacksonville, FL (US); Dylan Vaccaro, Jacksonville, FL (US); William H. Rogers, St. Augustine, FL (US); Gary Grochowski, Middleburg, FL (US)

(73) Assignee: Safariland, LLC, Jacksonville, FL (US)

( * ) Notice: Subject to any disclaimer, the term of this patent is extended or adjusted under 35 U.S.C. 154(b) by 273 days.

(21) Appl. No.: 18/196,589

(22) Filed: May 12, 2023

(65) Prior Publication Data

US 2023/0366654 A1 Nov. 16, 2023

Related U.S. Application Data

(60) Provisional application No. 63/341,560, filed on May 13, 2022.

(51) Int. Cl.
*F41C 33/02* (2006.01)
*F41C 33/04* (2006.01)

(52) U.S. Cl.
CPC ..... *F41C 33/0236* (2013.01); *F41C 33/045* (2013.01)

(58) Field of Classification Search
CPC .. F41C 33/0236; F41C 33/0245; F41C 33/02; F41C 33/0227; F41C 33/045
USPC ..... 224/912
See application file for complete search history.

(56) References Cited

U.S. PATENT DOCUMENTS

| | | | | |
|---|---|---|---|---|
| 5,358,160 | A * | 10/1994 | Bianchi | F41C 33/0227 224/198 |
| 6,854,626 | B2 * | 2/2005 | Liao | F41C 33/0263 224/244 |
| 9,004,328 | B1 * | 4/2015 | Galuppo, Jr. | F41C 33/0272 224/912 |
| 9,816,778 | B2 * | 11/2017 | Bardy | F41C 33/0272 |
| 10,473,426 | B2 * | 11/2019 | Tedder | F41C 33/0236 |
| 10,598,462 | B2 * | 3/2020 | Tedder | F41C 33/0263 |
| 11,105,584 | B2 * | 8/2021 | Rogers | F41C 33/0227 |
| 2007/0181619 | A1 * | 8/2007 | Seyfert | F41C 33/04 224/912 |

OTHER PUBLICATIONS https://aliengearholsters.com/shapeshift-modular-holster-system.html.

* cited by examiner

*Primary Examiner* — Corey N Skurdal
(74) *Attorney, Agent, or Firm* — Kane Kessler, P.C.; Paul E. Szabo

(57) ABSTRACT

A holster for carrying a handgun of the type having a front section including a muzzle, a middle section including a trigger guard, and a back section including a grip, includes a holster upper section with walls configured to substantially enclose the middle section of a handgun when the handgun is carried in the holster. The holster also includes a generally open holster web portion that extends forward from the holster upper section and that defines a window through which is visible a substantial portion of the front section of a handgun when the handgun is carried in the holster.

9 Claims, 6 Drawing Sheets

HOLSTER

BACKGROUND OF THE INVENTION

This application relates to a holster for a handgun, in particular, an inside the waistband ("IWB") holster. An IWB holster is used when the user wants to conceal or otherwise carry the handgun inside the user's trousers. Such holsters are generally smaller than standard holsters, to make them more comfortable to wear.

BRIEF DESCRIPTION OF THE DRAWINGS

Further features of the invention will become apparent to one of ordinary skill in the art to which the invention pertains from reading the following description together with the accompanying drawings, in which.

SUMMARY OF THE INVENTION

Figures 1, 2:
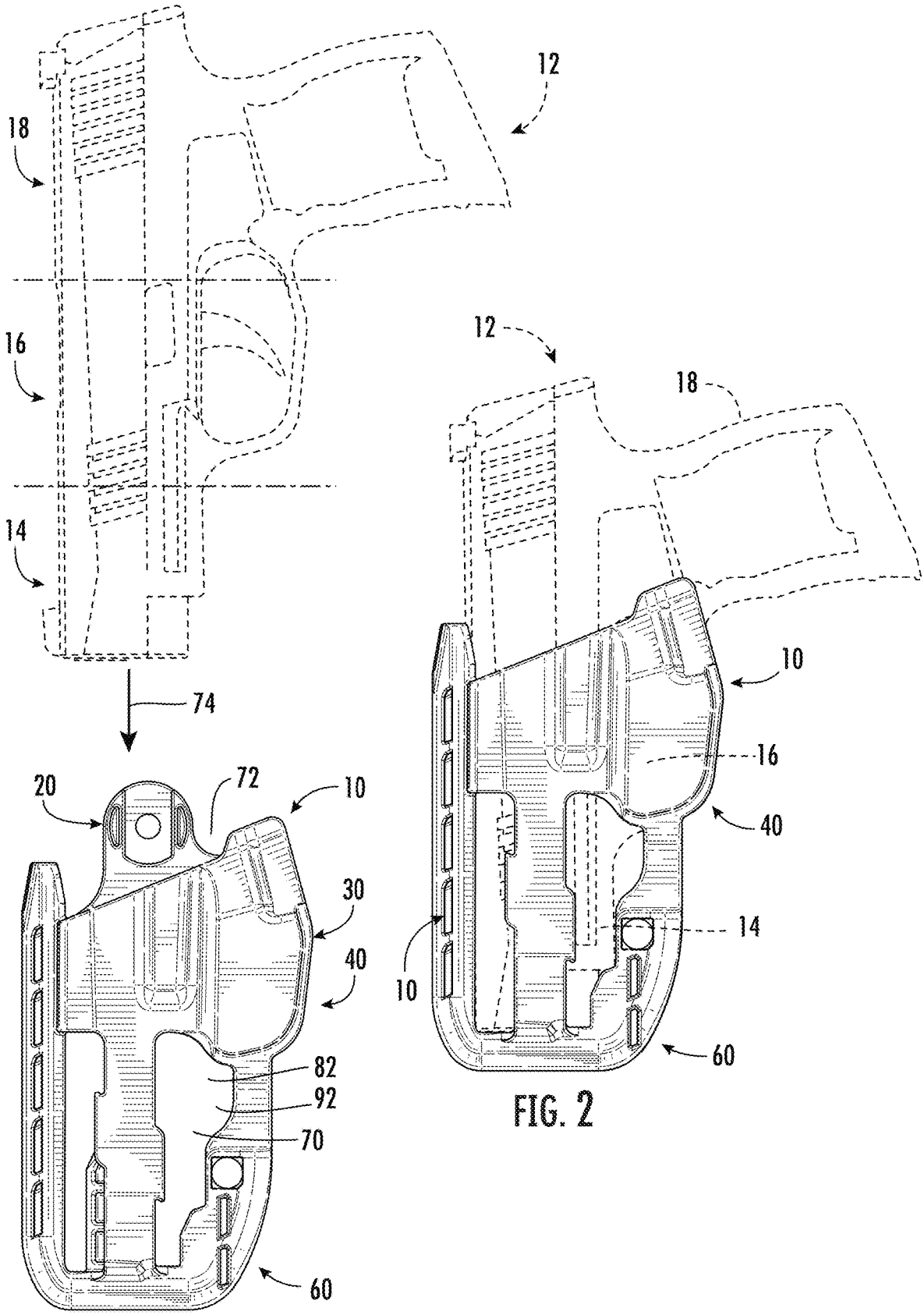
FIG. 1 is a body side elevational view of a holster that is a first embodiment of the invention, shown in an assembled condition and with a handgun illustrated schematically in a position to be inserted in the holster.
FIG. 2 is a view similar to FIG. 1 showing the handgun inserted in the holster.

The present invention relates to a holster for a handgun. In particular, the present invention relates to an inside the waistband ("IWB") holster of the minimalist style, although the invention is applicable to other types of holsters.

In accordance with a feature of the invention, the holster body volume is minimized for comfort and lower material usage, while still retaining full holster functionality, along with passive retention by the PRD. There are two large windows or openings in the holster that reduce significantly the amount of material of the holster. In addition, the bottom of the holster is open along the trigger guard area. Still, the holster retains the handgun well. Thus, full functionality is achieved while reducing holster material volume by exposing the handgun slide and frame by at least 30% more than traditional, fully enclosed IWB holsters. The holster body side profile surface area is reduced by 40%.

The holster upper section is made from holster wall material that substantially encloses the chamber and the handgun middle section. The holster web portion comprises only relatively narrow elements rather than the broad walls of the holster upper section.

These changes lead to reduced weight and material volume, thereby improving concealability and enhancing the aesthetic of the minimalist look of exposed handgun slide and frame. This also helps to minimize the amount of material that is used in manufacture of the holster, which is a desirable goal. Finally, the holster web section with its two windows provides a distinctive visual appearance for the holster.

Finally, the holster, though minimalist, still provides for passive retention of the handgun in the holster.

The invention relates to a holster for carrying a handgun of the type having a front section including a muzzle, a middle section including a trigger guard, and a back section including a grip, the holster comprising a holster upper section with face and body walls configured to substantially enclose the middle section of the handgun when the handgun is carried in the holster; and a generally U-shaped holster web portion that extends forward from the holster upper section and that includes ribs defining an open window, the web portion and window being configured to render visible a substantial portion of the front section of the handgun when the handgun is carried in the holster.

The invention also relates to a holster for carrying a handgun of the type having a front section including a muzzle, a middle section including a trigger guard, and a back section including a grip, the holster comprising a holster upper section with walls configured to substantially enclose the middle section of a handgun when the handgun is carried in the holster; and a generally open holster web portion that extends forward from the holster upper section and that defines a window through which is visible a substantial portion of the front section of a handgun when the handgun is carried in the holster.

DETAILED DESCRIPTION

The present invention relates to a holster for a handgun. In particular, the present invention relates to an inside the waistband ("IWB") holster, although the invention is applicable to other types of holsters. As representative of the invention, FIG. 1 illustrates a holster 10 that is a first embodiment of the invention; the invention is not limited to the illustrated embodiment.

The holster is 10 configured for use with a handgun 12 (FIGS. 1 and 2). The illustrated handgun is a semi-automatic handgun of a known construction. For descriptive purposes, and not limiting, the handgun 12 may be considered to have a front section 14 (below the lower dot-dash line in FIG. 1) that includes a front end of the frame, a frame rail, a front end of the slide, and a muzzle extension; a middle section 16 that includes a trigger guard, a trigger, an ejection port and an extractor; and a back section 18 (above the upper dot-dash line in FIG. 1) that includes a grip, a magazine well, and a backstrap. The holster 10 is configured for the particular model of handgun 12 that is to be carried.

Figure 4:
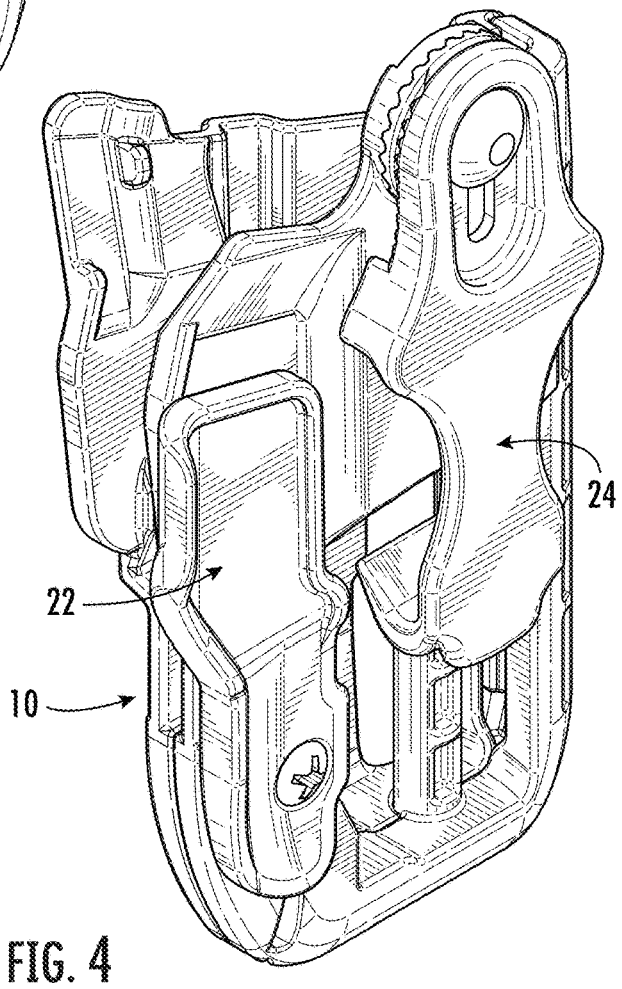
FIG. 4 is a view similar to FIG. 3 and showing additional pieces on the holster.
Figure 5:
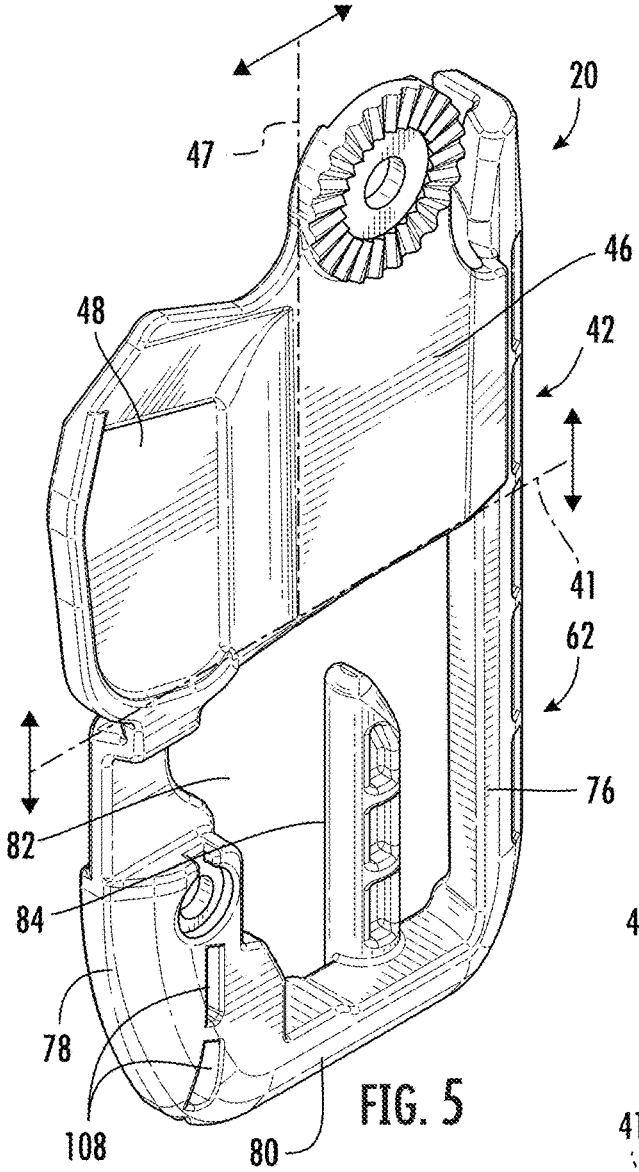
FIG. 5 is an outside perspective view of a face piece that forms one part of the holster of FIG. 1.
Figure 6:
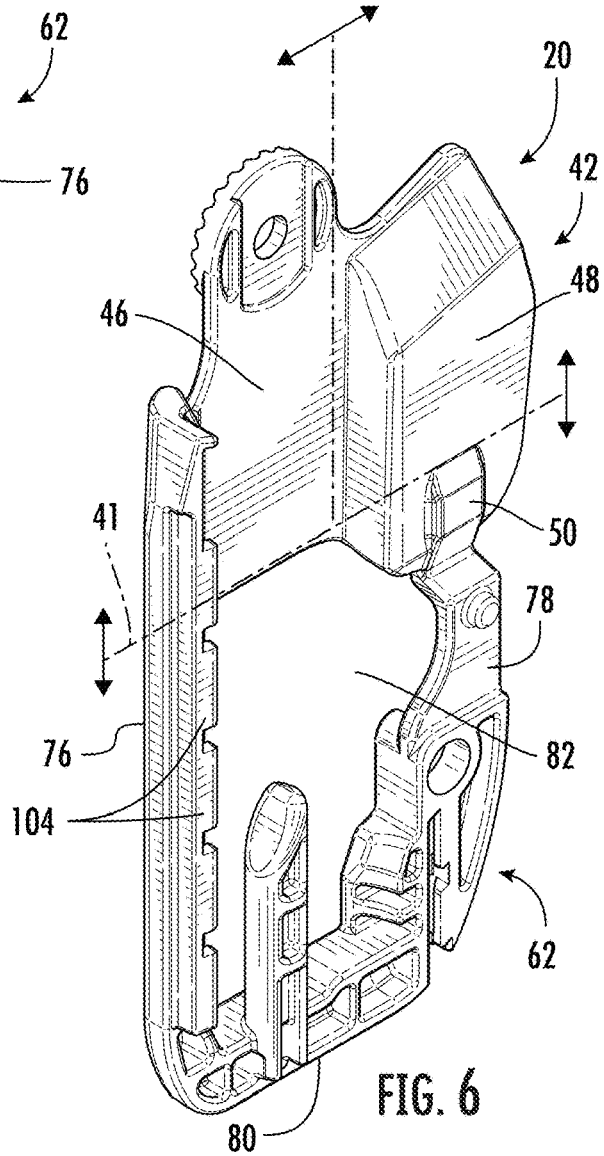
FIG. 6 is an inside perspective view of the face piece of FIG. 5.
Figure 7:
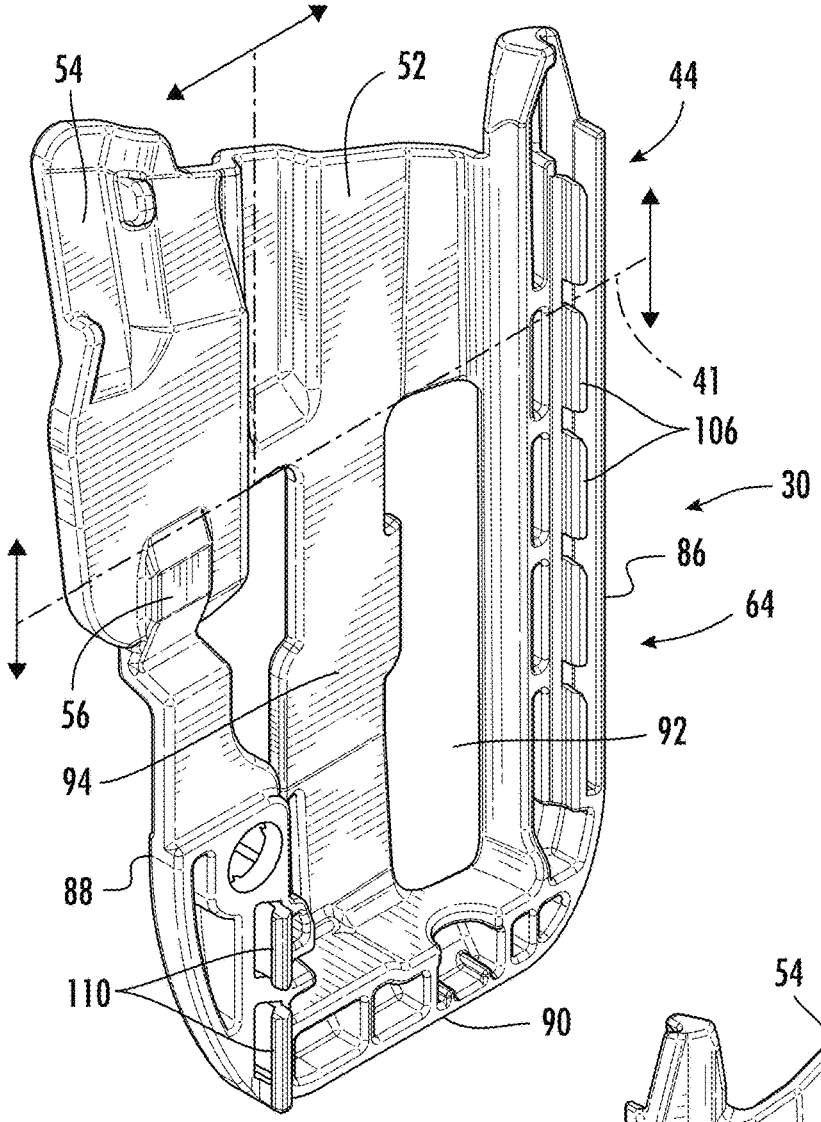
FIG. 7 is an inside perspective view of a body piece that forms one part of the holster of FIG. 1.
Figure 8:
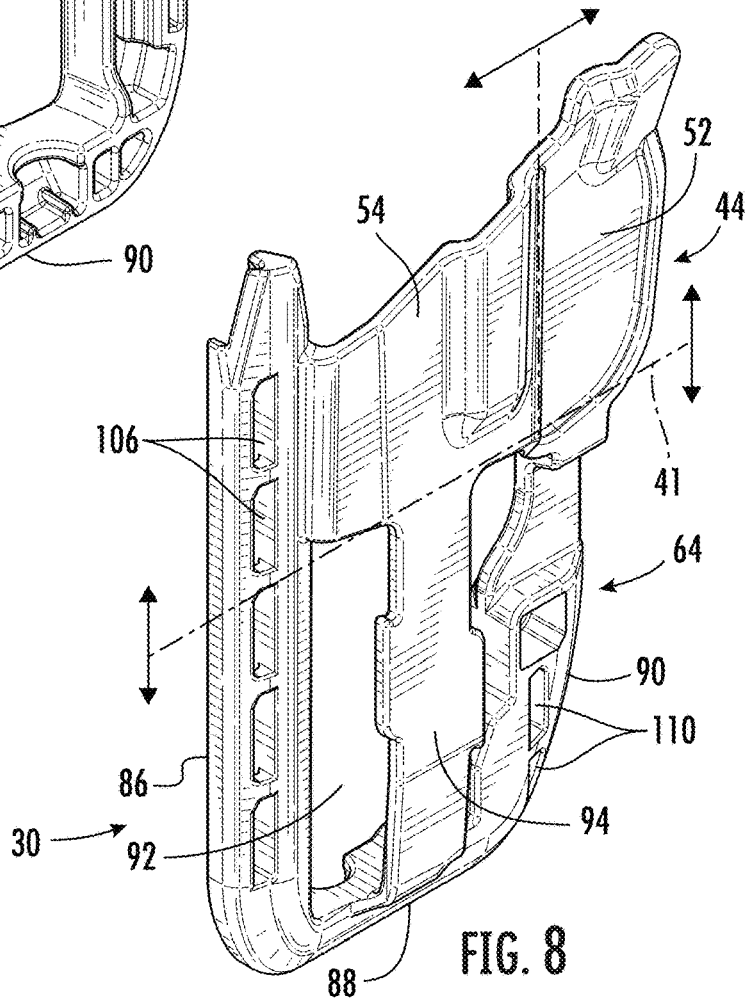
FIG. 8 is an outside perspective view of the body piece of FIG. 8.
Figure 9A:
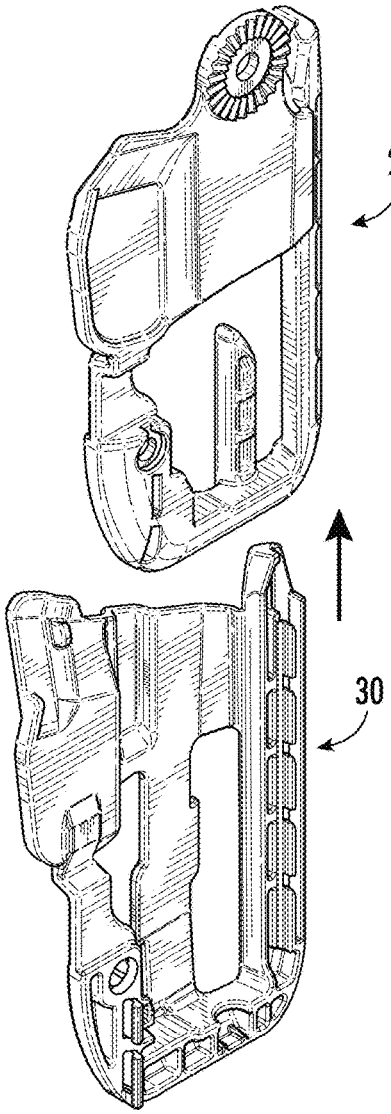
FIGS. 9A-9C are a series of views illustrating the assembly of the face piece with the body piece.
Figure 9B:
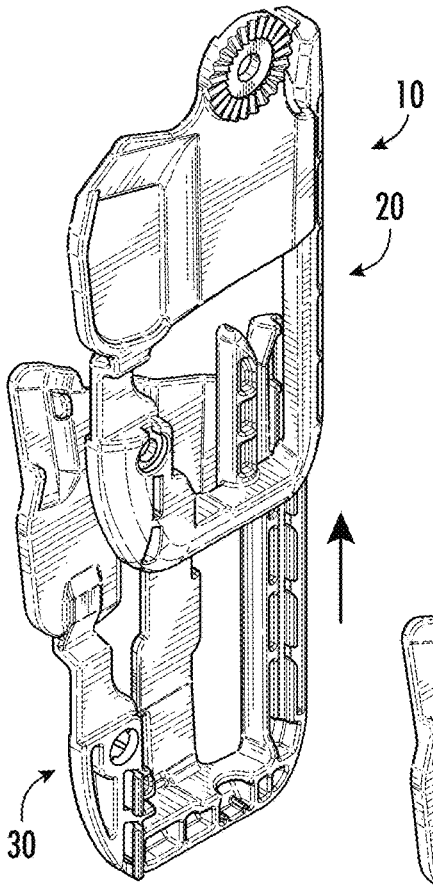
Figure 9C:
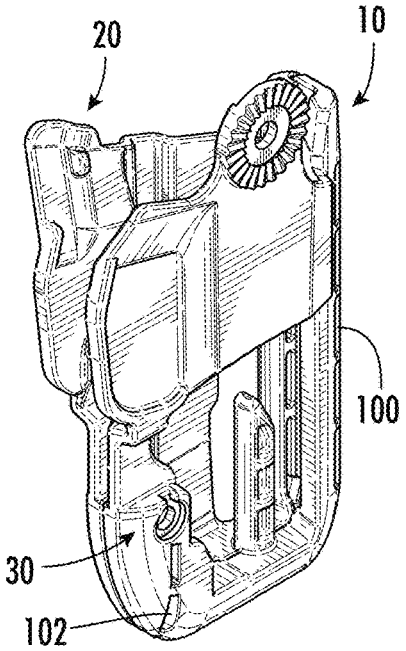
Figure 10:
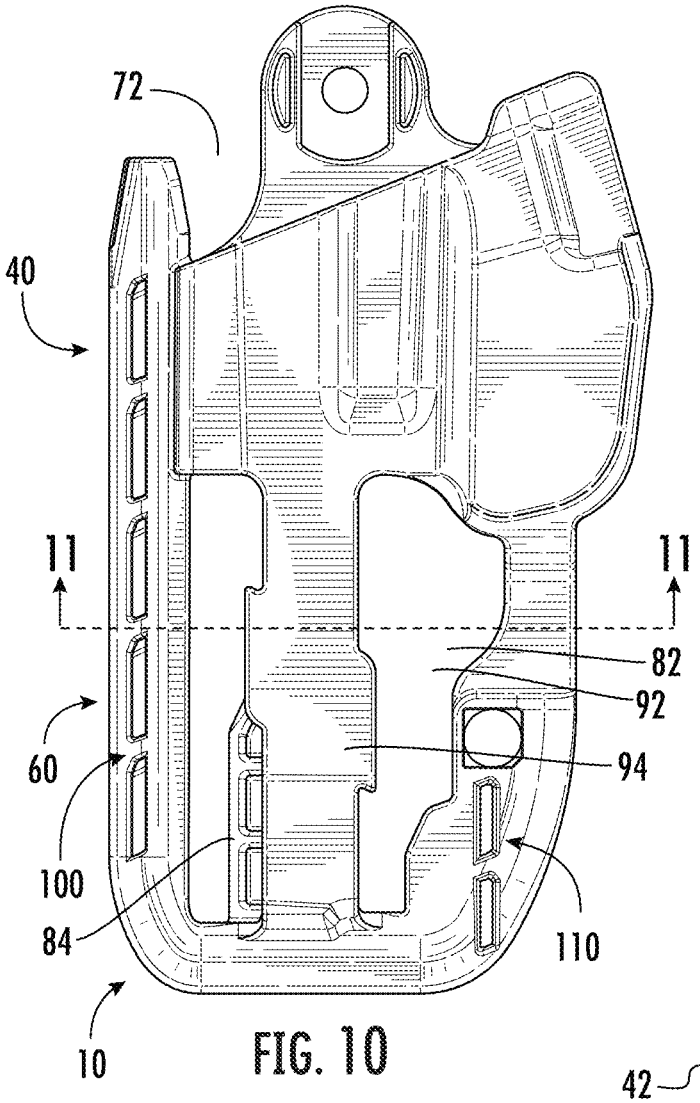
FIG. 10 is a body side elevational view of the assembled holster.

The holster 10 when assembled (FIG. 3) is made of two separate pieces joined together, specifically, a first piece or face piece 20 (FIGS. 5 and 6) and a second piece or body piece 30 (FIGS. 7 and 8). The face piece 20 is toward the outside (face side) of the user when the holster 10 is being worn, and the body piece 30 is toward the inside (body side) of the user when the holster is being worn. In the illustrated embodiment, both the face piece 20 and the body piece 30 are made from molded plastic, although that can vary. Together, the two pieces 20 and 30 form the holster 10 which accommodates the handgun. The holster 10 as illustrated also includes an optional tuck device 22 and belt clip 24 (FIG. 4) to meet end user preferences; these items are separate from the holster design and functionality, and do not form part of the invention.

The holster 10 (FIG. 3) includes generally a holster upper section 40 (above the dot-dash line 41 in FIG. 3) that receives the middle section 16 of the handgun 12. The holster 10 also includes a holster web section 60 (below the line 41 in FIG. 3) that receives the front section 14 of the handgun.

The holster upper section 40 comprises a face piece upper section 42 (FIGS. 5 and 6, above the line 41) and a body piece upper section 44 (FIGS. 7 and 8, above the line 41), which are joined together during assembly to form the holster upper section 40. The holster web section 60 comprises a face piece web section 62 (FIGS. 5 and 6, below the line 41) and a body piece web section 64 (FIGS. 7 and 8, below the line 41), which are joined together during assembly to form the holster web section 60.

The face piece upper section 42 (FIGS. 5 and 6) includes a face piece upper body section 46 (to the right of line 47 in FIG. 5) and a face piece trigger guard section 48 (to the left of line 47 in FIG. 5) that are constituted by holster walls which are substantially continuous with each other. A PRD ramp 50 (pistol retaining device ramp) with beveled ends is provided on the inside of the face piece 20, adjacent to the trigger guard section 48.

Similarly, the body piece upper section 44 (FIGS. 7 and 8) includes a body piece upper body section 52 and a body piece trigger guard section 54 that are constituted by holster walls which are substantially continuous with each other. A PRD ramp 56 with beveled ends is provided on the inside of the body piece 30, adjacent to the trigger guard section 54. The PRD ramp 56 on the body piece 30 is directly opposite the PRD ramp 50 on the face piece 20, but spaced apart to allow passage of the handgun trigger guard.

Figure 3:
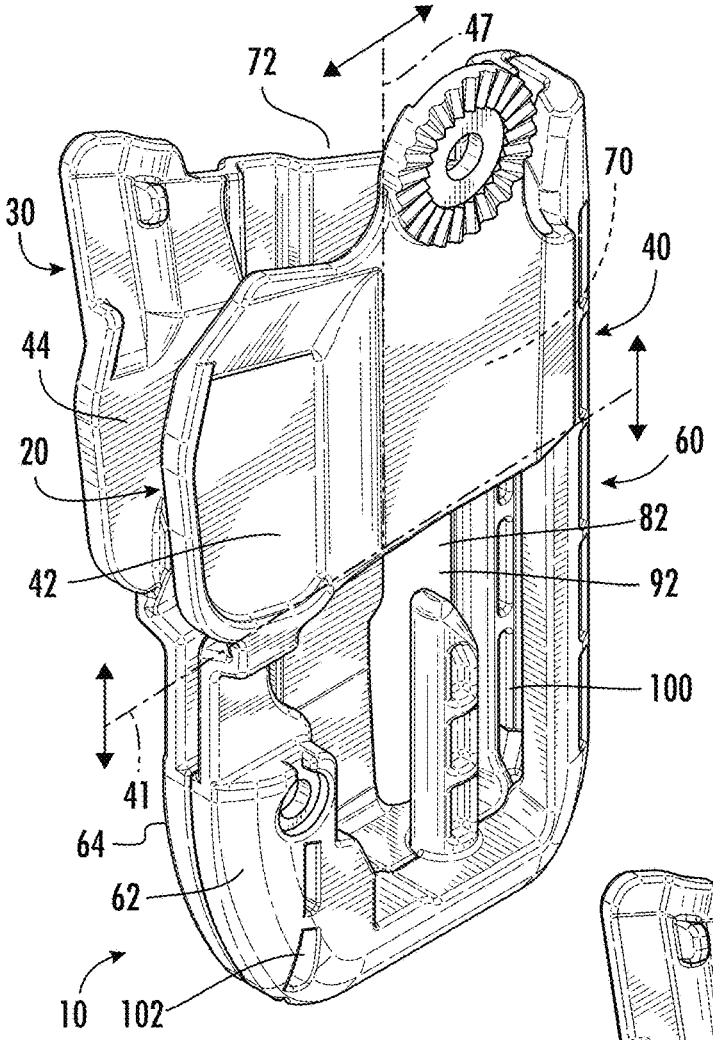
FIG. 3 is a face side perspective view of the assembled holster of FIG. 1.

When the face piece 20 is joined with the body piece 30 as shown in FIG. 3, their respective upper body sections 42 and 44 are adjacent to but spaced apart from each other, defining between them a chamber 70 (FIGS. 1 and 11) in the holster upper section 40. The upper body sections 42 and 44 define between them a mouth or entranceway 72 (FIG. 1) of the holster 10, into which the handgun 12 can be inserted for holstering. The entranceway 72 is completely or almost completely surrounded by holster wall material. The entranceway 72 is sized and shaped to provide for easy and accurate one-handed insertion of the handgun 12 into the holster 10 in the proper direction and orientation, while the holster is still being worn inside the waistband, because it provides a mouth encircling the handgun barrel when the handgun 12 is being re-holstered.

The entranceway 72 is thus one opening into the chamber 70, at the upper end of the chamber. At the opposite lower end of the chamber 70, the chamber opens into the web section 60 of the holster 10. The direction of insertion of the handgun 12, as indicated by the arrow 74 in FIG. 1, is from the entranceway 72 through the chamber 70 and into the web section 60 of the holster 10.

When the handgun 12 is holstered, the middle section 16 of the handgun is received in the chamber 70. The upper body section 42 of the face piece 20 and the upper body section 44 of the body piece 30 are together shaped and configured to engage and retain the middle section 16 of the handgun 12. The front section 14 of the handgun 12 is received in the web section 60 of the holster 10. The back section 18 of the handgun 12, including the grip, is outside of the holster 10.

The holster web section 60 extends or projects outward from the holster upper section 40 and is generally U-shaped in configuration. As noted above, the holster web section 60 is made up of the face piece web section 62 and the body piece web section 64, which are joined together during assembly to form the holster web section 60.

The face piece web section 62 (FIGS. 5 and 6) extends or projects outward from the face piece upper section 42 and is generally U-shaped in configuration. The face piece web section 62 includes three ribs: a first rib 76 that extends outward from the face piece upper body section 46; a second rib 78 that extends outward from the face piece trigger guard section 48, generally parallel to the first rib; and an end rib 80 that extends between and interconnects the distal ends of the first and second ribs 76 and 78. The ribs 76 and 78 extend generally parallel to the direction of insertion 72, and the end rib 80 extends generally normal to the direction of insertion.

The three ribs 76, 78, 80 of the face piece web section 62 form three sides of an opening or window 82 in the face piece 20. The fourth side is formed by the walls of the face piece upper section 42. A muzzle plug 84 extends upward partially across the face piece window 82 from the end rib 80 in a direction toward the face piece upper body section 46. Other than the muzzle plug 84, the window 82 is open, that is, there is no holster wall material present. The area of the face piece window 82 is about 15% of the overall area of the face piece 20.

Similarly, the body piece web section 64 (FIGS. 7 and 8) extends or projects outward from the body piece upper section 44 and is generally U-shaped in configuration. The body piece web section 64 includes three ribs: a first rib 86 that extends outward from the body piece upper body section 52; a second rib 88 that extends outward from the body piece trigger guard section 54, generally parallel to the first rib 86; and an end rib 90 that extends between and interconnects the first and second ribs 86 and 88. The ribs 86 and 88 extend generally parallel to the direction of insertion 72, and the end rib 90 extends generally normal to the direction of insertion.

The three ribs 86-90 of the body piece web section 64 form three sides of an opening or window 92 in the body piece 30, the fourth side being formed by the walls of the body piece upper section 44. A body side web 94 extends upward across the body piece window 92 from the end rib 90 and terminates at the body piece upper body section 52. Other than the body side web 94, the window 92 is open, that is, there is no holster material. The area of the body piece window 92 is about 30 of the area of the overall body piece 30.

The holster 10 has two dovetail joints 100 and 102 for joining together the face piece 20 and the body piece 30. Each one of these two joints 100, 102 is split into a plurality of longitudinally spaced apart sections, for molding purposes. Specifically, there is a set of upper dovetail elements 104 along the upper body section and web section of the face piece 20, and a mating set of upper dovetail elements 106 on the upper body section and web section of the body piece 30. There is a set of lower dovetail elements 108 along the face piece web section 62, and a mating set of lower dovetail elements 110 on the body piece web section 64.

Figure 11:
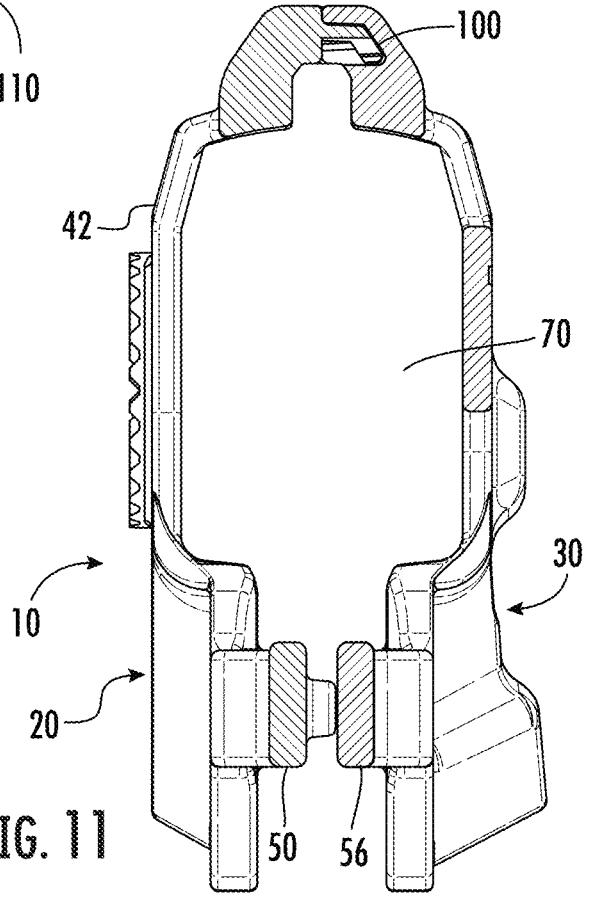
FIG. 11 is a sectional view taken generally along line 11-11 of FIG. 10.

The respective sets of dovetail elements come together securely when sliding the two pieces together as shown in FIG. 11. The engagement of the dovetail elements positions and securely joins the face piece 20 with the body piece 30 to thus form the holster 10. The face piece web section overlies the body piece web section to form the holster web section.

In accordance with a feature of the invention, the handgun 12 can be re-holstered in a single motion, one-handed. This is possible because the face piece upper body section 41, and the body piece upper body section 44, have solid walls which together form the holster upper section 40, providing a firm mouth or entranceway 72 into which the barrel of the handgun 12 can be easily inserted without looking. The entranceway 72 is sized and shaped to provide for easy and accurate one-handed insertion of the handgun 12 into the holster 10 in the proper direction and orientation, while the holster is still being worn inside the waistband, because it provides a mouth encircling the handgun barrel when the handgun 12 is being re-holstered. The holster 10 can stay in place inside the user's waistband and the user can simply insert the handgun 12 one-handed into the holster, as with a full holster, in contrast to other minimalist inside the waistband holsters. The walls of the holster upper section 40 provide enough holster body material to define an entranceway 72 that enables correct one-handed insertion of the handgun 12 into the holster 10. The holster 10 does not need to be removed from the user's trousers in order to reholster the handgun 12.

When the handgun 12 is thus holstered, the middle section 16 of the handgun is located in the upper section 40 of the holster 10. The upper body section 46 of the face piece 20 and the upper body section 52 of the body piece 30 are each shaped and configured to engage and contain the middle section 16 of the handgun 12. Thus, the handgun 12 is securely contained in the holster 10.

When the handgun 12 is being holstered, the muzzle plug 84 on the face piece 20 inserts into the muzzle of the handgun 12. This engagement also helps to position and secure the handgun 12 in the holster 10. The holster web section 60 receives the front section of the handgun 12. The body side web 94 extends between the handgun 12 and the user's body, to reduce the risk of burns from a hot handgun 12.

In accordance with a feature of the invention, the holster body volume is minimized for comfort and lower material usage, while still retaining full holster functionality of re-holstering and drawing, along with passive retention by the PRD. Providing the two large windows or openings 82 and 92 in the holster 10 reduces significantly the amount of material of the holster. In addition, the bottom of the holster 10 is open along the trigger guard area. Still, the holster retains the handgun 12 well. Thus, full functionality is achieved while reducing holster material volume by exposing the handgun slide and frame by at least 30% more than traditional, fully enclosed IWB holsters. The holster body side profile surface area is reduced by 40%.

The holster upper section is made from holster wall material that substantially encloses the chamber and the handgun middle section. The holster web portion comprises only relatively narrow elements rather than the broad walls of the holster upper section.

These changes lead to reduced weight and material volume, thereby improving concealability and enhancing the aesthetic of the minimalist look of exposed handgun slide and frame. This also helps to minimize the amount of material that is used in manufacture of the holster, which is a desirable goal. Finally, the holster web section 60 with its two windows 82 and 92 provides a distinctive visual appearance for the holster.

In accordance with another feature of the invention, the holster 10, though minimalist, still provides for passive retention of the handgun 12 in the holster—that is, a physical means of keeping the handgun 12 in the holster and preventing inadvertent or unauthorized withdrawal, other than simply a friction fit of the handgun 12 in the holster. Upon insertion of the handgun 12 into the holster 10, the leading edge of the trigger guard engages the beveled ends of the PRD ramps 50 and 56 and pushes the ramps outward, away from each other, thus forcing out also the trigger guard sections 42 and 44, respectively, of the two holster pieces 20 and 30. When the handgun 12 is far enough into the holster 10, the leading edge of the trigger guard passes over the PRD ramps 50 and 56 and they flex back toward their original position and their flats engage each other, inside the trigger guard, thus passively holding the handgun 12 in place. The angle of the beveled ends of the PRD ramps 50 and 56 determines the resistance "feel" during holstering and drawing. The distance between the two flats on the two PRD ramps 50 and 56 determines the overall feel of retention during holstering and drawing.

From the above description of the invention, those skilled in the art will perceive improvements, changes and modifications in the invention. Such improvements, changes and modifications within the skill of the art are intended to be covered by the appended claims.

The invention claimed is:

1. A holster for carrying a handgun of the type having a front section including a muzzle, a middle section including a trigger guard, and a back section including a grip, the holster comprising:

a holster upper section with face and body walls configured to substantially enclose the middle section of the handgun when the handgun is carried in the holster; and a generally U-shaped holster web portion that extends forward from the holster upper section and that includes ribs defining an open window, the web portion and window being configured to render visible a substantial portion of the front section of the handgun when the handgun is carried in the holster;

wherein the holster comprises a face piece and a body piece that are joined together to form the holster, the holster face piece including the upper section face walls and the body piece including the upper section body walls;

wherein the holster web portion comprises (i) a generally U-shaped face piece web section that is part of the face piece and that includes a first rib that extends outward from the upper section face walls generally parallel to the direction of insertion, (ii) a second rib that extends outward from the upper section face walls generally parallel to the first rib, and (iii) an end rib that extends between and interconnects the distal ends of the first and second ribs, the first rib and the second rib and the third rib together forming three sides of a window in the face piece;

and (i) a generally U-shaped body piece web section that is part of the body piece and that includes a first rib that extends outward from the upper section body walls generally parallel to the direction of insertion, (ii) a second rib that extends outward from the upper section body walls generally parallel to the first rib, and (iii) an end rib that extends between and interconnects the distal ends of the first and second ribs, the first rib and the second rib and the third rib together forming three sides of a window in the body piece;

and the window in the face piece overlying the window in the body piece to form the open window in the holster web portion.

2. A holster as set forth in claim 1 wherein:

the face piece includes an upper section and a trigger guard section that are substantially continuous with each other to form a main body portion of the face piece; and the body piece includes an upper section and a trigger guard section that are substantially continuous with each other to form a main body portion of the face piece;

the upper section of the face piece being joined to the upper section of the body piece when the face piece and the body piece are joined together, and the trigger guard section of the face piece being located closely adjacent to but spaced apart from the trigger guard section of the body piece, the holster upper section defining a mouth or entranceway of the holster into which a handgun can be inserted for re-holstering.

3. A holster as set forth in claim 2 wherein each trigger guard section includes a PRD ramp, the two PRD ramps being located opposite each other and configured to retain a handgun in the holster by engagement with the handgun trigger guard.

4. A holster as set forth in claim 1 wherein each first and second rib extends generally parallel to the direction of insertion, and each end rib extends generally normal to the direction of insertion.

5. A holster as set forth in claim 1 wherein each one of the face piece and the body piece includes a series of dovetails on its respective upper section for slidingly joining the face piece with the body piece.

6. A holster as set forth in claim 1 wherein the holster web portion exposes a handgun front section by at least 30% more than traditional, fully enclosed IWB holsters.

7. A holster as set forth in claim 1 wherein the body piece includes a body side web that extends across the body piece opening, from the lower section to the upper section, configured to shield a user's body from a hot handgun.

8. A holster as set forth in claim 7 wherein the face piece includes a barrel plug that extends partially across the face piece opening, from the lower section to the upper section.

9. A holster as set forth in claim 1 wherein the face piece includes a barrel plug that extends partially across the face piece opening, from the lower section to the upper section.

* * * * *